United States Patent [19]

Ullner

[11] Patent Number: 4,731,950

[45] Date of Patent: Mar. 22, 1988

[54] AIRTIGHT CLOSING SLIDING DOOR WITH CONTACT PRESSURE AND INTEGRATED ONE-HAND OPERATION

[75] Inventor: Friedrich Ullner, Zwickau, German Democratic Rep.

[73] Assignee: Ing. Friedrich Ullner, Bautechnische Kuehlraumausstattung, Zwickau, German Democratic Rep.

[21] Appl. No.: 879,974

[22] Filed: Jun. 30, 1986

[51] Int. Cl.[4] ..... E05D 15/10

[52] U.S. Cl. ..... 49/221; 49/224

[58] Field of Search ..... 49/221, 223, 224, 225, 49/209

[56] References Cited

U.S. PATENT DOCUMENTS 3,886,685 6/1975 Riphagen ..... 49/221 X 3,950,893 4/1976 Calais et al. ..... 49/224

FOREIGN PATENT DOCUMENTS 2053689 5/1972 Fed. Rep. of Germany ..... 49/223

*Primary Examiner*—Philip C. Kannan

[57] ABSTRACT

An improved airtight closing sliding door with contact pressure and integrated one-hand operation which lowers itself in its closed position and thereby hermetically seals the door frame as well as the door sill by way of continuously effective contact pressure whose door leaf is suspended from the cam plate of a carrying shaft, and which is lowered from horizontally to vertically downwards position by turning the carrying shaft.

5 Claims, 5 Drawing Figures

AIRTIGHT CLOSING SLIDING DOOR WITH CONTACT PRESSURE AND INTEGRATED ONE-HAND OPERATION

BACKGROUND OF INVENTION

This invention concerns an airtight closing sliding door with contact pressure and integrated one-hand operation which lowers itself in its closed position and thereby hermetically seals the door frame as well as the door sill by way of continuously effective contact pressure.

The sliding door may find favorable use as cold storage room or freezer room door, as fire protection door, or as a soundproofing door in the construction industry.

DESCRIPTION OF THE PRIOR ART

Airtight closing sliding doors are known in the art. There are sliding doors which are suspended on a carrying shaft rotatable by an operation device and which by operation, radially drop after sliding shut. Also known are doors which are suspended in the sliding area on hinged runners, tilted towards the outside, and supported against a sliding rail with support rolls. In the closed position the said support is freed and the door leaf falls on end by way of its own weight. Other sliding doors are known in which the sealing is achieved by way of an inclined plane of the running surface, as contrasted to the floor and to the wall surface. Further, there are sliding doors, which in their closed position, show a recess in the guide rail, which can be vertical as well as diagonal, which thereby lowers the door leaf.

A drawback in all of the aforementioned types of sliding doors, with door leafs which drop on end by way of their own weight, is the missing horizontal contact pressure, which is critical for a proper hermetic sealing.

The opening and closing of these doors of the prior art is achieved by cranks or hand wheels which are held above dead center of rotation in the high position, and illustrate a cumbersome method of servicing. The doors which achieve their sealing properties solely by way of an inclined plane suffer from extremely strong friction which requires a high amount of applied force to overcome this friction.

DD-WP No. 230,584 discloses a suspension and counterbalanced apparatus for cold storage room sliding doors whose door leaf suspension swings from horizontally outwards, to vertically downwards, receiving an adjustable transverse pressure by way of hinged, tiltably positioned compression springs with which the door leaf is suspended in its open position, and the direction of the spring force is shifted transversely downwards during closing into a contact pressure. By turning the compression springs around during closing, the necessary contact pressure is achieved, however it should be noted that this process involves the vigorous slamming of the door and results in high abrasion, particularly with regard to the sealing strip.

DD-WP No. 230,893 discloses a suspension and counterbalanced device for cold storage room sliding doors for which lifting and compression springs are used, whereby the lifting spring is arranged on an idler gear in the suspension runner and allows for a less vigorous closing of the door. This apparatus, however, is also not designed for achieving a soft closing and opening of the door such that motorization and automation of the opening and closing of the door leaf is functionally achieved.

SUMMARY OF THE INVENTION

The object of the present invention is to overcome the disadvantages entailed in the prior art which employ suspended compression springs which are hinged to an idler gear.

A further object is to achieve a harmonization in the operation process of closing and lowering, and lifting and opening of the door leaf, such that the door leaf falls softly and independently shut into its closed position.

A further object of the invention is the realization of an automatic closing device for the sliding door and a motorized operation process.

The present invention of an airtight closing sliding door, with contact pressure and one-hand operation whose door leaf is suspended from the cam of a carrying shaft, and which is lowered from horizontally outwards to vertically downwards by twisting the carrying shaft, has the following features:

The carrying shaft is connected with the cam of the camshaft by powerful, holding up, compression springs with a pressure of $\frac{2}{3}$ to $\frac{3}{4}$ of the weight of the door leaf and by holding down contact springs by means of tiltable spring connecting hinges. Two suspension cams are coaxially arranged on the carrying shaft showing bearing bores for the suspension hinge of the adjustable suspension stirrup which is connected with the door leaf; whereby the axis of the suspension hinge, in the closed position, is situated vertically under the axis of the carrying shaft, and the first connecting rod hinge is displaced or staggered by 45° towards the door frame on the suspension cam.

The cam plates arranged on a camshaft which is frontally supported on the carrying shaft, are connected with the suspension cams of the carrying shaft by way of the second connecting rod hinges, and the connecting rod and the first connecting rod hinges hinged thereto; whereby, the distance from the first connecting rod hinges to the axis of the carrying shaft is in a ratio of 1:2 with the distance from the second connecting rod hinges to the axis of the camshaft.

A rocker arm is supported on the locking side suspension runner, whose load arm is connected to the cam plates by way of a sliding bearing and a lifting mechanism, and upon whose power arm a roller is runningly arranged on the guide rail.

The spring connecting hinges of the holding up compression springs are in alignment with the axes of the carrying and camshafts during the closed position of the door leaf, while the contact springs are hinged to the cam plates and displaced by approximately 45°.

The operation by means of a motor is enabled by a motor operating lever, standing vertically upwards and arranged opposite to the locking side suspension runner, and connected to a motor by a traction cable or drag chain; whereby, a safety spring arranged between the motor operating lever and the drag chain or traction cable is mechanically connected to an emergency cut-in and the motor operating lever is connected with the cam plates by way of a lifting hinge and a lifting mechanism.

A time delayed independently closing airtight sliding door shows, at the height of the guide rail, a retraction cable clamped on the locking side suspension runner, which is connected to a laterally arranged cable drum; whereby, a traction cable and pawl with an attached weight, or with a connected tension spring, is arranged on the cable drum, which is connected to a timing relay by means of a tie rod and a short stroke magnet. The weight attached to the traction cable consists of numerous partial weights.

MODE OF OPERATION

In the open position of the sliding door, the cams of the carrying shaft, which protrude horizontally from said shaft and upon which the door leaf is hung, are braced by one or more holding up compression springs with a compression force of $\frac{2}{3}$ to $\frac{3}{4}$ of the door leaf weight, during which the remaining holding up force is supplied by a rocker arm rolling on the guide rail. The compression springs operate tensionally on the protruding cams of a forward supported camshaft by means of tiltable hinges of the rigidly supported carrying shaft, said camshaft transferring this partial force by means of retroactive connecting rods to the cams of the carrying shaft and the door leaf weight hung thereon. Since the connecting rods are diverted from the cams of the carrying shaft only by approximately half the axial distance, as is the camshaft, an approximate 90° turn of the carrying shaft effects only an approximate 45° turn of the camshaft (see FIGS. 2 and 3).

During the closed position of the door, the compression springs, which are hinged with interslidable spring brackets, are in alignment with the axes of the carrying shaft and the camshaft, so that the action of force in this position, by way of the missing lever arm, is cancelled with respect to the axis of rotation, and the system compresses. In this position, in which the action of force of the compression springs is cancelled, the contact springs, displaced by approximately 45°, develop their maximum action of force. However, during the raised position of the door, these effects are exactly opposite. By means of the arrangement of the two different springs, the holding up force and the contact force can be independently tensioned and adjusted.

As a result of the taking over of $\frac{2}{3}$ to $\frac{3}{4}$ of the holding up force, by means of the compression springs and the remaining weight by means of the rocker arm guided along the guide rail, the downwards withdrawal movement of the rocker arm, resulting at the end of the guide rail, effects a soft dropping movement of the door leaf with a minimum of remaining weight, because the compression springs still have a counter effect. The total force required for the operation is less than that required for sliding doors of similar construction because the adjusted spring forces always remain the same.

Likewise, a synchronized process of sliding and closing, and opening and sliding is achieved by means of the additional upwardly positioned motor operating lever, movable by motor with a traction cable or a chain, whose force effect is homologously engaged to the opposing suspension runner; and which can be realized by means of a very simple motorized switching between two terminal switches.

Due to the very light sliding force, it is possible to annex a timed delay self closing device by means of a traction cable wound on a cable drum; wherein, the cable drum is constantly pulled towards the closing direction by an additionally spooled traction cable with hanging weights or a tension spring. Through the use of weights attached to the traction cable, the effect of the division of intercoupled partial weights, which are only all raised from the floor when the door is completely open, is to allow for a secure advance of the said door after release of the cable drum pawl. Furthermore, after the lifting out of the door leaf, the somewhat greater force required for pushing the same out of the rest position is not increased by the full extent of the weights, but only by a partial weight.

The total concept of radially lowering the door leaf from horizontally outwards to vertically downwards allows for an almost horizontal coming into contact of the door leaf, such that the abrasion affecting sealing strip friction is avoided, except at the two lower outer corners.

BRIEF DESCRIPTION OF THE DRAWINGS

These and other objects and features of the invention will become apparent with reference to the specification and to the following drawings in which.

DETAILED DESCRIPTION OF THE PREFERRED EMBODIMENT

The invention is described with reference to the attached drawings.

Figure 1:
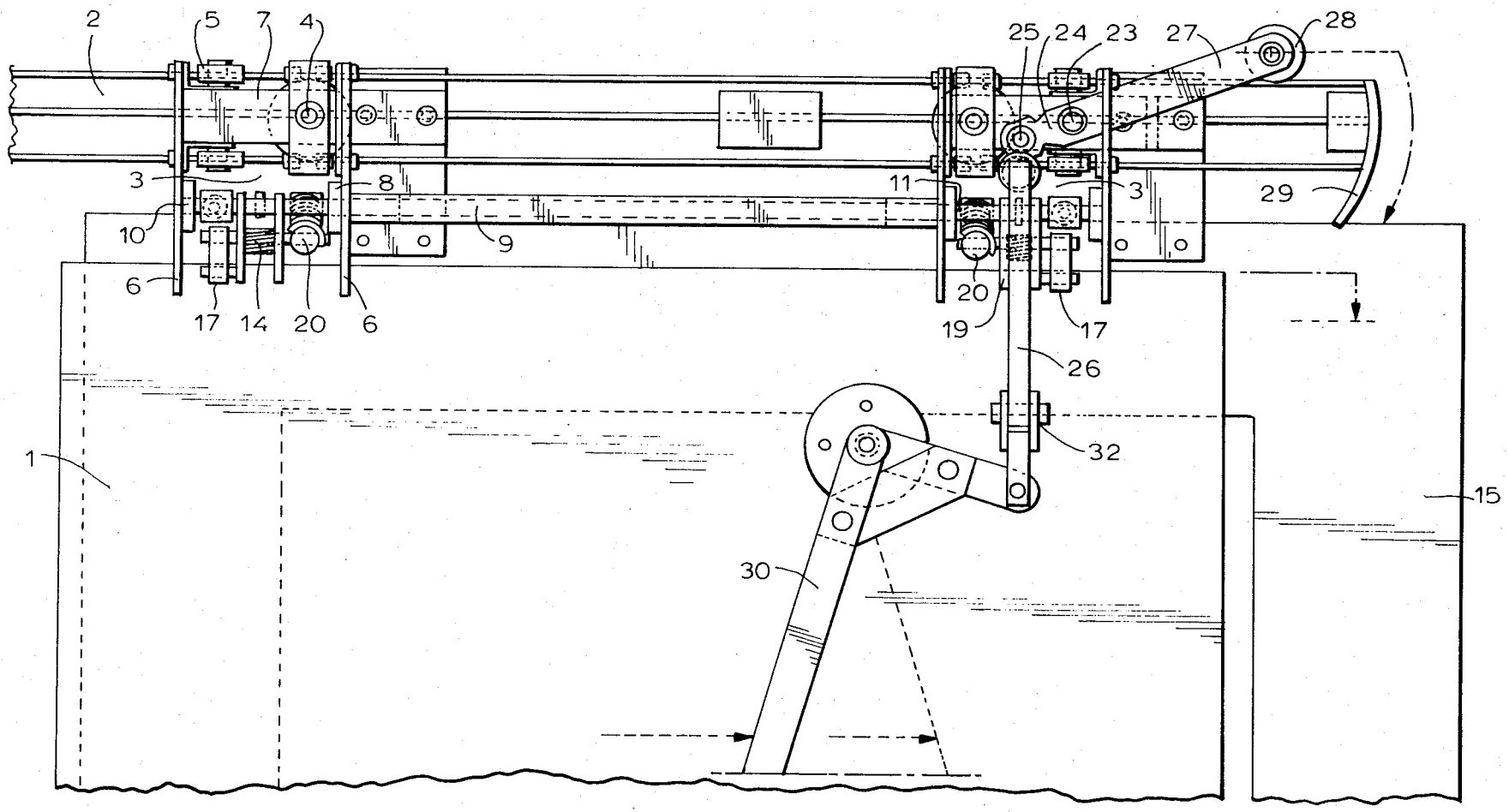
FIG. 1 shows a view of the door leaf with suspension construction and operating apparatus.

As shown in FIG. 1, two suspension runners 3 are hung on the external side of the door leaf 1 to a guide rail 2 comprised of two connected angle brackets. In order to conserve construction height, the suspension runners 3 are provided with runners 4 which are arranged inside the U-formed composite profile of the guide rail 2. The suspension runners 3 are rigidly supported by means of guide rollers 5.

The suspension runners 3 are comprised of two lateral vertical runner web plates 6 and a transversely connected roller base plate 7. The carrying shaft bearings 8 for mounting the carrying shaft 9 are arranged on the internal side of the web plates 6 and on the external side of the same are arranged the camshaft bearings 10 of the camshaft 11. Two suspension cams 12, each comprised of two bearing bores, are welded coaxially onto the carrying shaft 9.

Figure 3:
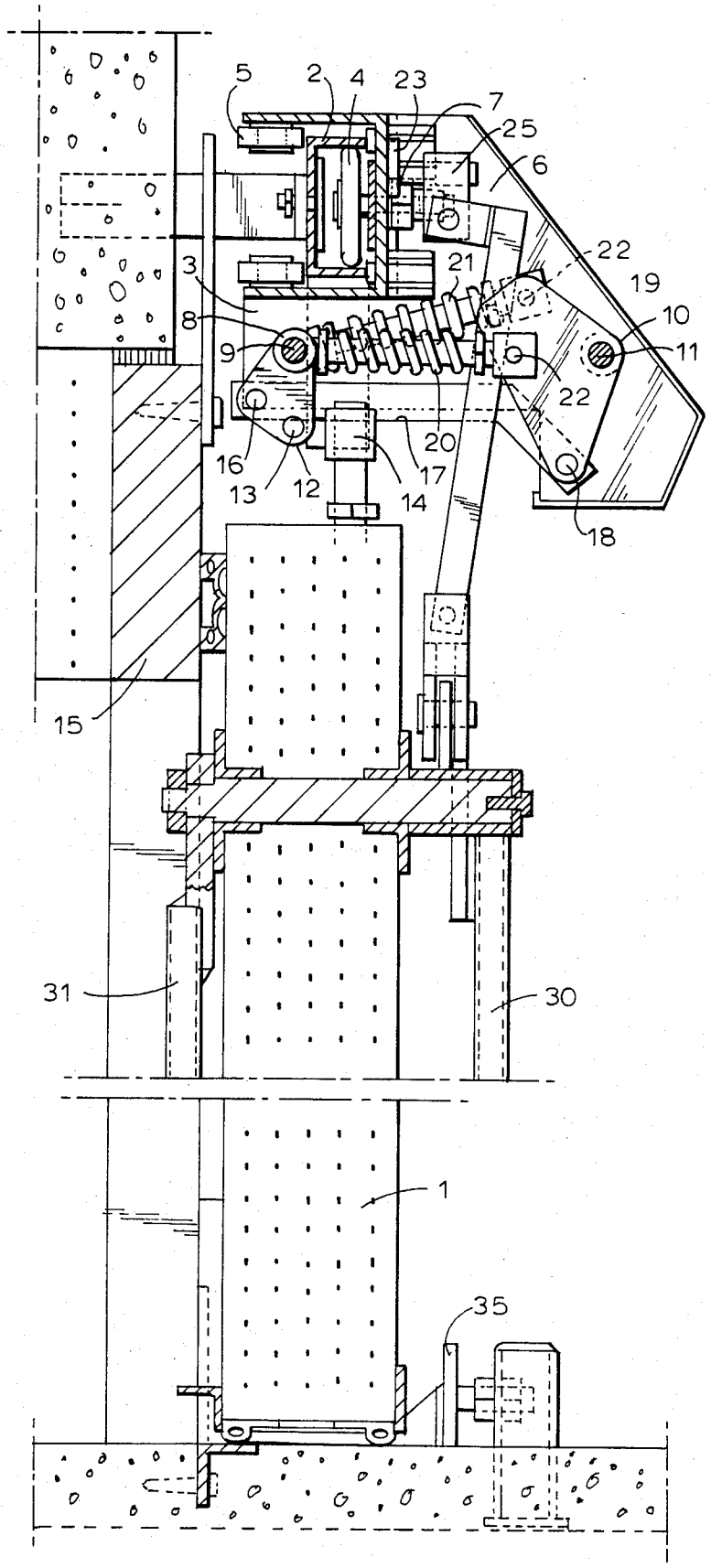
FIG. 3 shows a vertical cross section of the door leaf with suspension construction and lower guide during closed position.

In the closed position, shown in FIG. 3, the lower situated bore functions as suspension hinge 13 for the adjustable suspension stirrup 14 on which the door leaf 1 is hung. The bore, intended for 45° displacement towards the door frame 15, functions as the first connecting rod hinge 16 for the hinging or pivoting of a force transferring connecting rod 17. The other end of this connecting rod 17 is hinged on the forward supported camshaft 11 at the second connecting rod hinge 18 of the cam plate 19. The distance from the first connecting rod hinge 16 to the carrying shaft axis has a ratio of 1:2 to the distance between the second connecting rod hinge 18 and the camshaft axis. Therefore, an approximate 90° turn of the carrying shaft 9 results in only an approximate 45° turn of the camshaft 11.

Powerful holding up compression springs 20, and contact springs 21 with tiltable spring connecting hinges 22, are installed between the carrying shaft and the cam plate 19 of the camshaft 11. Each of the spring forces alternate between a maximum and zero depending upon the position of the camshaft 11, i.e. the distance of the action of force to the axis of rotation of the camshaft 11.

In the closed position of the door leaf 1, shown in FIG. 3, the spring connecting hinges 22 of the holding up compression springs 20 are in alignment with the axes of the carrying shaft 9 and the camshaft 11, such that the action of force of the compression springs 20 is cancelled in this position. In contrast, the contact springs 21 on the cam plate 19, displaced approximately 45°, have reached their maximum action of force. They effect the contact pressure of the door leaf 1 against the frame and sill.

Figure 2:
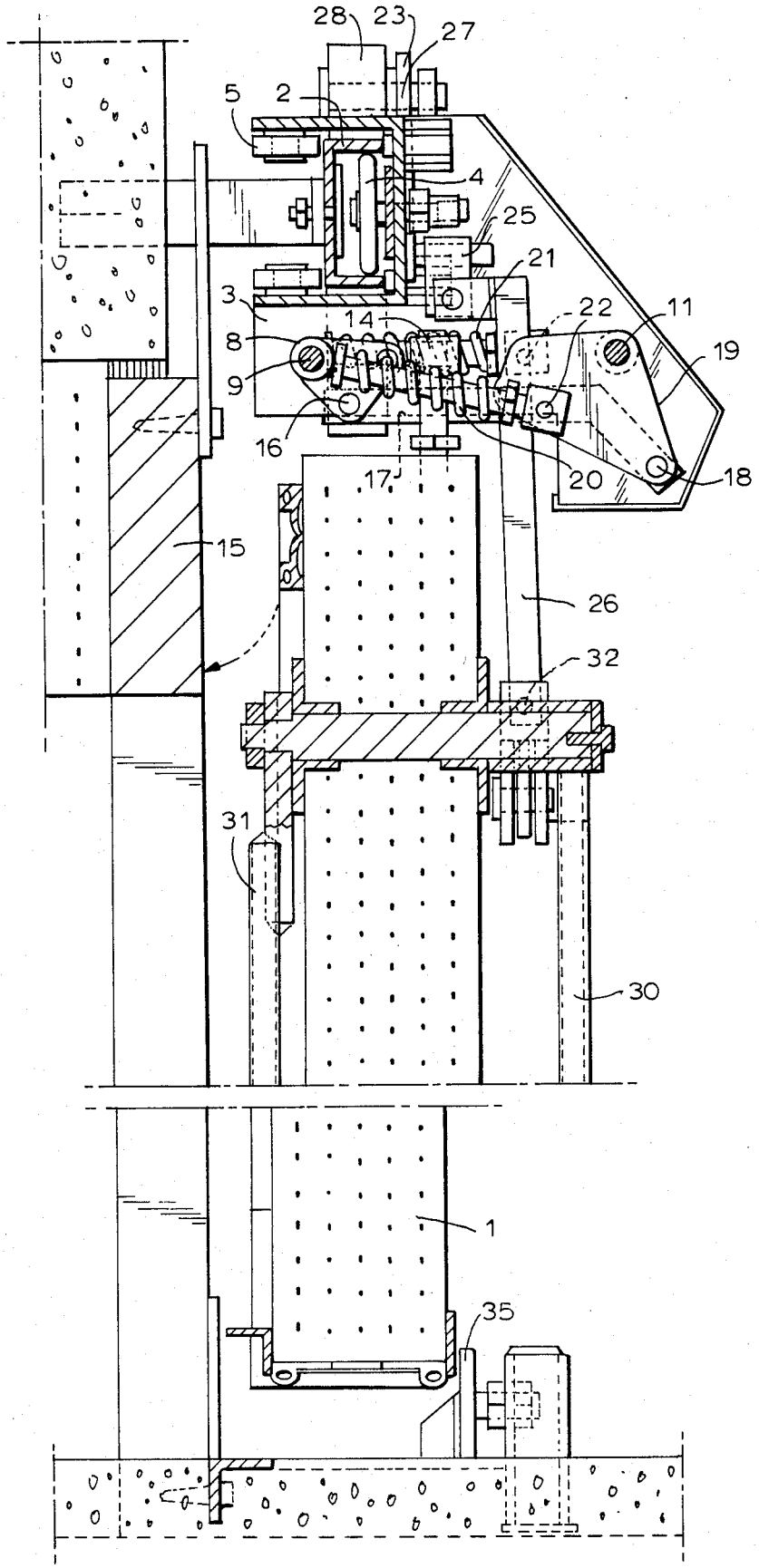
FIG. 2 shows a vertical cross section of the door leaf with suspension construction and lower guide during open position.

In contrast, in the open position of the door leaf 1, shown in FIG. 2, the action of force of the compression springs 20 reaches the maximum with approximately $\frac{2}{3}$ to $\frac{3}{4}$ of the door leaf weight. A rocker arm 23 is situated on the locking side suspension runner 3 for the purpose of holding up the remaining weight of $\frac{1}{4}$ to $\frac{1}{3}$ of the door leaf 1, whose load arm 24 takes up this weight portion by way of a sliding bearing 25 and a lifting machanism 26 from the camshaft plate 19 of the camshaft 11, and transfers the weight over the power arm 27, and by means of a roller 28, onto the guide rail 2 as pressure. Thereby, the load arm - power arm transfer of the movable rocker arm 23 results in a very small roller pressure of 1:4 to 1:8.

As is clearly illustrated in FIG. 3 the camshaft plate 19 is also pivotally connected to the lifting mechanism (arm) 26 between the spring connecting hinges 22. This connection effects the force transfer from the lever 30 via the hinge 32, the arm 26 to the camshaft plate 19 and tilts the latter about the camshaft 11.

In the closed position of the door leaf 1, shown in FIG. 3, the roller 28 of the power arm 27 has reached the end of the guide rail 2 and can fall back, with its minimal remaining weight, downwards over a sink arc 29. The sink arc 29 simultaneously prevents a premature sliding open of the door leaf 1 by the raising of the same. The raising of the door leaf 1 results by means of an manually operated lever 30, and emergency opening lever 31, arranged on the inner and outer side of the door leaf 1, respectively. The action of force, of the said lever, being in the same direction as the respective sliding direction. The operating force is transferred by way of a lifting hinge 32 of the lifting mechanism 26 on the end of the load arm 24 of the rocker arm 23, and a sleeve bearing 25 onto the cam plate 19 of the camshaft 11, and also onto the rocker arm 23; such that the power arm 27, with its roller 28, as well as the door leaf 1, can be raised or lowered.

As is clearly illustrated in FIG. 1 a pivot slide connection is provided by means of the sleeve bearing 25 between the arm 26 and the load arm 24 of the rocker arm 23. The power arm 27 and load arm 24 are pivoted on the rocker arm 23.

Figure 4:
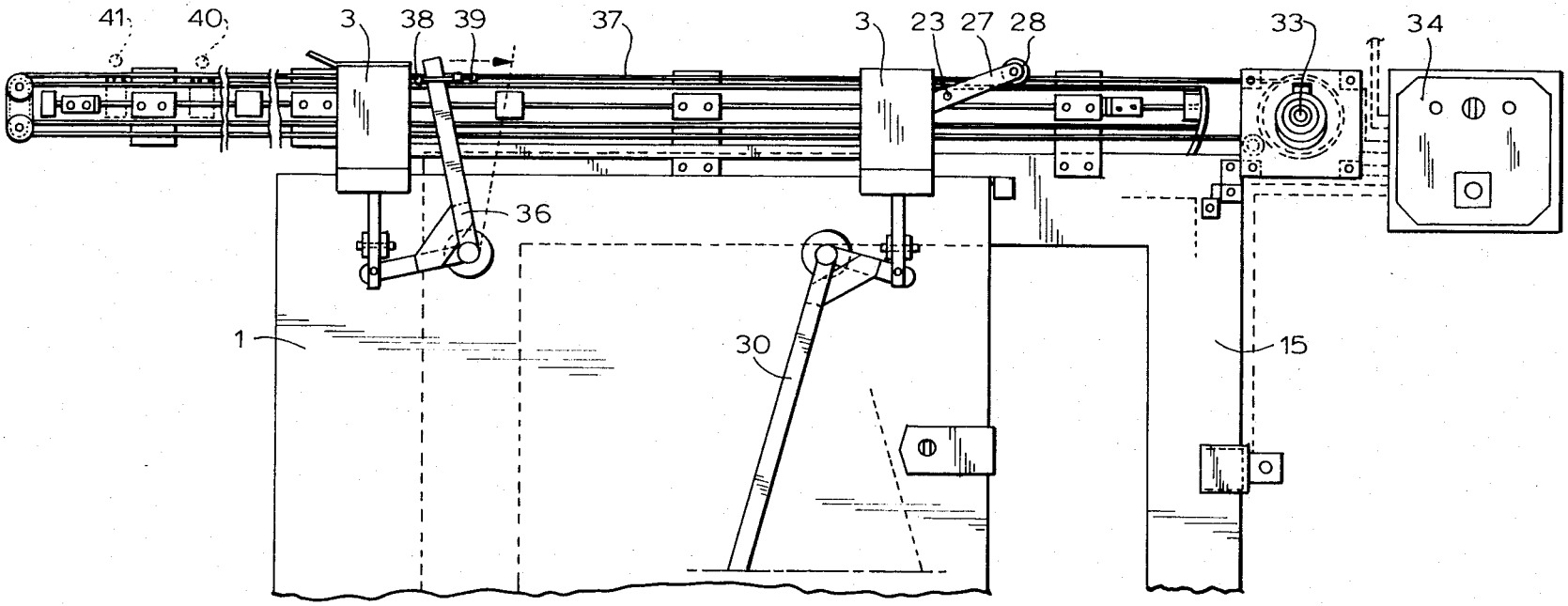
FIG. 4 shows a view of the motorized drive mechanism.

The lower guide and contact pressure of the door leaf 1 results through the known means, by way of an iron guide 35, which has an adjustable inclined surface, in the downward direction for the sliding in of the door leaf 1 during lowering. In addition to the manually operated manual operation lever 30, or also independently of said manual lever, an upwardly standing motor operating lever 36 can be installed on the opposite suspension runner 3 for the operation with a motor 33, as shown in FIG. 4; which can be moved by motor by means of a traction cable 37 or a drag chain 37. As shown, this embodiment also provides for the synchronized operation of sliding and closing, i.e. opening and sliding, by way of the interposition of a lifting hinge 32 of a lifting mechanism 26 and the cam plate 19 of the camshaft 11 as described above; and, therefore, also results in a very simple motorized distributing board 34.

As is clearly illustrated in FIG. 4 the left suspension runner 3 corresponds to the right one except that it has no rocker arm 23 but is provided with a motor operating lever 36 which is connected to the motor 33 via the drag chain 37.

The pulling of the motor operating lever 36 by the traction cable 37 or the drag chain 37 results in accordance with safety technology by way of a safety spring 38 which, after a certain adjustable load, i.e. compression, mechanically operates an emergency cut-in 39 arranged between the coupling; such that when people or vehicles are caught, the door leaf 1 opens up immediately. The increased initial boosting force from the rest position is bridged in this regard by mean of a corresponding switch between the first cut-in switch 40 and the second cut-in switch 41, which are approximately 20 cm apart. Therefore, the emergency cut-in results only after the approximately 20 cm starting path.

Figure 5:
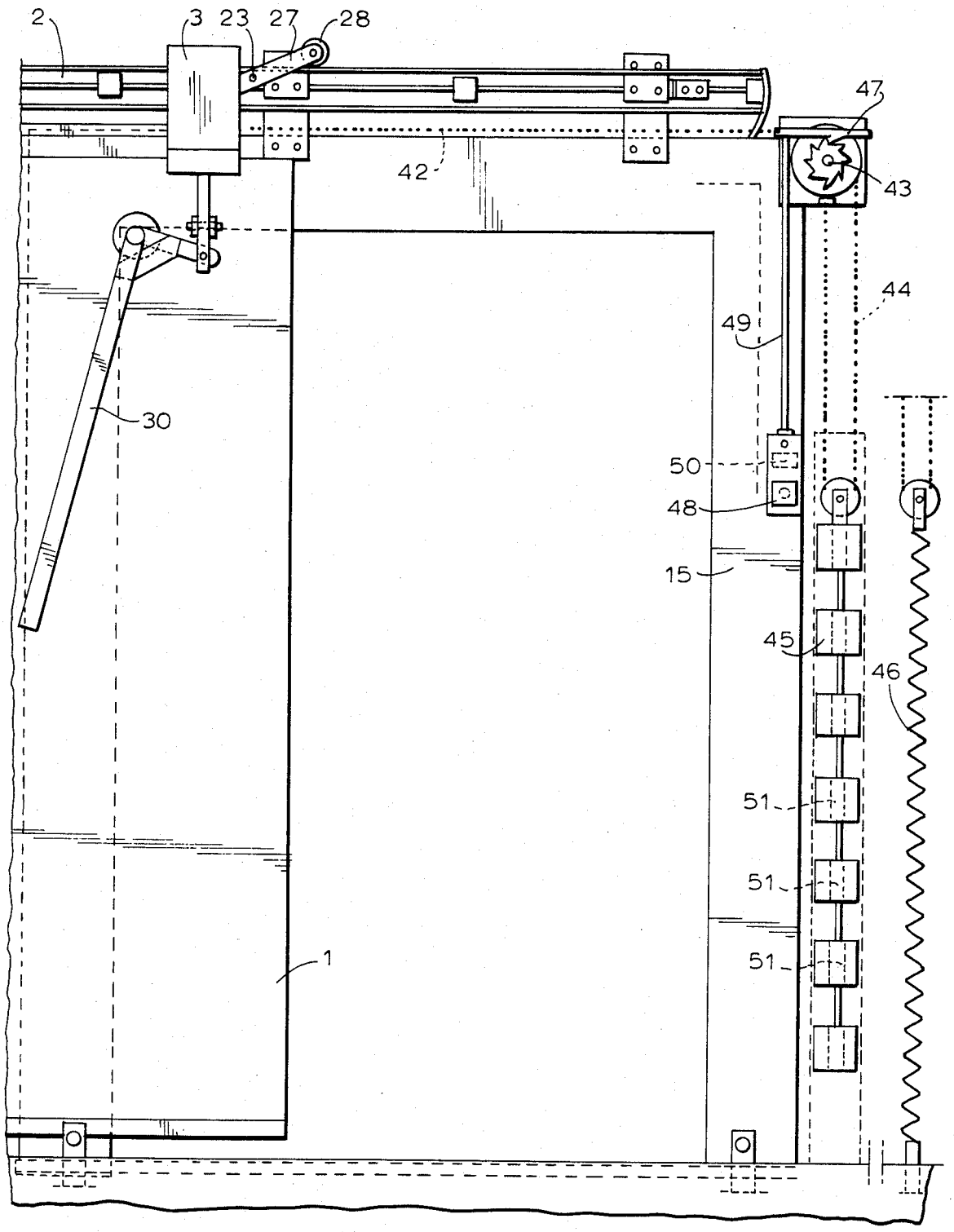
FIG. 5 shows a schematic illustration of the independent closing mechanism.

FIG. 5 shows a supplement to the manual operation, i.e. a time delayed independent closing apparatus. A retraction cable 42 is fastened at the height of the guide rail 2 to the locking side suspension runner 3, and is wound up or unwound by a laterally arranged cable drum 43. The cable drum 43 is in turn constantly pulled in the closing direction, as long as nothing prevents it from doing so, by a wound traction cable 44 with a coupled weight 45 or a tension draw spring 46.

To achieve the time delay for passage through the door, a pawl 47 is laterlly arranged on the cable drum 43 which, after the expiration of a time period set on an electrical time relay 48, is released by means of a tie rod 49 and a short stroke magnet 50. Subsequently, the door leaf 1 is pulled into its closed position by the weight 45 or the tension draw spring 46, after which it independently falls closed according to the system previously described.

The pulling force consists of intercoupled partial weighs 51, which are all raised from the floor when the door is completely open, and assure a secure advance of the same after release of the cable drum pawl 47. Furthermore the increased initial pushing force required for pushing the door out of the rest position is not immediately increased by the full extent of the weights, but only by a partial weight 51. The same holds true for the embodiment using one or more tension springs 46.

While there has been described a particular embodiment of the invention, it will be apparent to those skilled in the art that variations may be made thereto without departing from the spirit and scope of the appended claims.

We claim:

1. An airtight closing sliding door having automatic sealing contact pressure and integrated one-hand operation and having a pair of suspension runners and a door leaf suspended from said pair of runners, each runner having a cam shaft and a cam plate and a carrying shaft on which said cam plate is rigidly mounted and which is turned about 90 degrees from an open position in which the cam plate is positioned horizontally downwards to a closed position in which the cam plate is positioned vertically by turning the carrying shaft, comprising a carrying shaft which is rigidly connected to
a first cam plate which is pivotally connected to
a camshaft which is rigidly connected to a second cam plate;
holding up compression and holding down contact springs with a compression force of $\frac{2}{3}$ to $\frac{3}{4}$ of the door leaf weight respectively pivotally connected to said first and second cam plates
said door leaf is pivotally connected to said first cam plate via
a suspension hinge of an adjustable suspension stirrup
a first connecting rod pivotally connected to said first and second cam plates,
the distance between the axis of said cam shaft and the pivot connection of said first connecting rod on said second cam plate is about 1.5 to 2.00 times the distance between the axis of said carrying shaft and the pivot connection of said first connecting rod on said first cam plate, whereby, the axis of the suspension hinge of said door leaf is situated vertically under the axis of the carrying shaft when the door is in a closed position, and the suspension hinge is displaced by 90 degrees when in an open position, whereas the second cam plate is displaced by 45° away from the door leaf when it is in an open position,
a rocker arm is pivotally mounted on one of said pair of suspension runners
the load arm of the rocker arm is pivotally connected with the second cam plate; and
a lifting mechanism operatively connected to said rocker arm, and on whose power arm is arranged
a roller running on a guide rail.

2. An airtight closing sliding door according to claim 1, wherein,
said suspension runner, having a bearing,
a motor operating lever, standing vertically upwards and arranged on the opposite suspension runner is connected to a motor operatively mounted on said guide rail and
a traction cable or drag chain connected to said motor and at least one of said suspension runners.

3. An airtight closing sliding door according to claim 2 wherein, at the height of the guide rail,
a retraction cable is fastened onto the locking side of a suspension runner of said pair of runners and is connected to
a laterally arranged cable drum mounted on said guide rail, and
a traction cable is connected to said cable drum and a pawl engages said drum;
an attached weight is arranged on the cable drum for pulling said sliding door closed.

4. An airtight closing sliding door according to claim 3, wherein the weight consists of
intercoupled partial weights.

5. An airtight closing sliding door according to claim 2 wherein, at the height of the guide rail,
a retraction cable is fastened onto the locking side of a suspension runner of said pair of runners and is connected to a laterally arranged cable drum mounted on said guide rail, and a traction cable is connected to said cable drum and a pawl engages said drum; a tension spring is operatively connected to said cable drum for pulling said sliding door closed.

* * * * *